United States Patent [19]

Tabor

[11] 3,989,976

[45] Nov. 2, 1976

[54] SOLID-STATE HID LAMP DIMMER

[75] Inventor: James B. Tabor, Wheaton, Ill.

[73] Assignee: Westinghouse Electric Corporation, Pittsburgh, Pa.

[22] Filed: Oct. 7, 1975

[21] Appl. No.: 620,443

[52] U.S. Cl. ..... 315/291; 315/194; 315/258; 315/283; 315/DIG. 4

[51] Int. Cl.[2] ..... H05B 41/38

[58] Field of Search ..... 315/194, 199, 208, 283, 315/284, 291, 307, DIG. 4

[56] References Cited

UNITED STATES PATENTS

| | | | |
|---|---|---|---|
| 3,369,150 | 2/1968 | Malmin | 315/194 |
| 3,816,794 | 6/1974 | Snyder | 315/283 X |
| 3,875,458 | 4/1975 | Kappenhagen | 315/291 X |
| 3,875,460 | 4/1975 | Kappenhagen | 315/DIG. 4 |
| 3,894,265 | 7/1975 | Holmes et al. | 315/199 X |

*Primary Examiner*—Eugene La Roche
*Attorney, Agent, or Firm*—W. D. Palmer

[57] ABSTRACT

Lighting control apparatus for controlling the light intensity of high-intensity-discharge (HID) lamps operated from an AC source while eliminating the tendency for such lamps to extinguish during the dimming thereof. The apparatus comprises a variable reactive ballast controlled with respect to its reactance by a solid-state switching device which is responsive to a timed control signal provided by a signal generating device operating from the same AC source. A lamp voltage sensing device develops a feedback signal which varies in accordance with the voltage drop across the lamps being ballasted. A signal sensing and overriding device combines the feedback signal and the timed controlled signal and causes the feedback signal to override the timed control signal before the lamp voltage reaches such value as might cause the lamp to extinguish. In this manner, when the lamp is dimmed and its voltage tends to rise, the voltage rise is automatically compensated for by an increase in power to the lamp which in turn decreases the voltage drop across the lamp so that the tendency of the lamp to extinguish during dimming thereof is eliminated.

5 Claims, 5 Drawing Figures

SOLID-STATE HID LAMP DIMMER

CROSS-REFERENCES TO RELATED APPLICATIONS

In copending application Ser. No. 559,463, filed Mar. 18, 1975, by the same inventor and owned by the same assignee, is described a high-pressure-discharge lamp dimmer for two such lamps connected in series across a ballasting device which supplies twice the normal ballast output voltage and in which the dimmer is preferably current feedback stabilized. This series connected lamp combination allows a greater dimming range, since when the voltage is impressed after both lamps have been off for some fraction of a half-cycle, the voltage tends to appear primarily across one of the lamps, starting that lamp. The voltage across the lamp which has started then quickly drops and the available voltage then predominantly appears across the other lamp, starting it as well. This action provides reliable operation at relatively low power levels where the lamps are intended to be off for a significant portion of each half cycle.

In copending application Ser. No. 558,109, filed Mar. 13, 1975, by J. C. Engel and owned by the same assignee, is described a dimmer for high-pressure-discharge lamps using a variable duty cycle photocoupler. The circuit described in this copending application provides isolation of the low voltage demand circuitry from the higher voltage lamp circuitry by means of an LED and a photosensitive resistor and avoids the nonlinearity problems normally associated with such photocouplers by using an ON/OFF duty cycle rather than proportional signals.

BACKGROUND OF THE INVENTION

This invention relates to lighting systems which control the level of illumination of one or more lamps, such as in a stage lighting system or in other lighting applications where varying intensities of lighting are desired. In particular, this present invention relates to controlling the intensity of light from high-pressure-discharge lamps, rather than incandescent or low-pressure-discharge lamps such as those of the tubular fluorescent type.

If high-pressure-discharge lamps are used with a dimmer which is not specifically designed for such lamps, the performance is generally unsatisfactory. Solid-state dimmers generally control the portions of each half cycle during which voltage from an AC voltage source is supplied to the lamp load. High-pressure-discharge lamps can extinguish when the voltage remains off for a significant portion of a half cycle and the normal ballasting which is used typically will not reestablish the arc once it is extinguished. Several prior art systems have minimized this problem by the use of a ballast which has two portions, such that the series inductance can be changed by means of a solid-state switch, typically a switch of the so-called triac design. This can be accomplished with a parallel reactor portion and a solid-state switch in series with one of the reactor portions to disconnect it for a portion of each half cycle. This can also be accomplished with two reactor portions in series and a solid-state switch which shorts out one of the reactor portions for a part of each half cycle. U.S. Pat. No. 3,816,794 issued June 11, 1974 to Snyder is one example of such a system.

Because of the difficulties of control, typically only one or two discharge lamps are operated from a single dimmer. This leads to a relatively expensive dimming system because of the number of dimmers involved and also because of the expense of running conduits both for power and for low voltage control wiring to each fixture. In addition, problems generally have been encountered in obtaining a wide range of light intensities from discharge lamps. At the lower intensity end, the lamps are somewhat hard to control and tend to drop out, i.e. extinguish, and once having dropped out, the lamps are difficult to restart and generally require several minutes to cool prior to restarting. At the higher intensity end, difficulties are often encountered due to the trigger pulse to the solid-state switch arriving prematurely, i.e., before current reversal. Because the circuit is inductive, the current is lagging and premature trigger pulses will be ineffective. This results in no power being supplied during that particular half cycle with the result that either the lamp will blink or more probably will drop out and cannot be restarted until the lamp has cooled.

SUMMARY OF THE INVENTION

There is provided a lighting control apparatus which is responsive to a variable and controllable demand signal to control the power input to high-pressure-discharge lamp devices and thus vary the light output therefrom while preventing the lamp devices from extinguishing because of a too-rapid reduction in power input thereto. The apparatus comprises a ballasting means which is connectable in series with the ballasted lamps and an AC power source. The ballasting means comprises a reactance which is variable between a minimum value which causes the lamp to operate at a maximum light output and a maximum reactance value which causes the lamp to operate with a minimum light output. A solid-state switching device connects to the ballasting device to controllably vary the reactance of the ballasting device in response to a timed control signal which varies in a controllable fashion the power input to the lamps and thus varies the light output therefrom. A signal generating device is responsive to the demand signal to generate a control signal timed to occur at a variable and controllable point in each half cycle of the AC power source and the output of the signal generating device is connected to the input of the solid-state switching device. In this fashion the generated timed control signal renders the solid-state switching device conductive for a variable and controllable portion of each half cycle of the AC power source. In order to prevent lamp drop out during dimming, a lamp voltage sensing device develops a feedback signal which varies in accordance with the voltage drop across the lamp and it has been found that when the lamp is dimmed, its voltage tends to rise. When the voltage rises to a value greater than the input voltage available, the lamp drops out. To overcome this tendency, there is provided a signal sensing and overriding device which senses the magnitude of the feedback signal and causes the feedback signal to override the control signal during such time that the voltage drop across the operating lamp is excessive. Since the feedback signal overrides the control, the power input to the operating lamp is increased which causes the voltage drop across the lamp again to decrease. Thus the rate of lamp dimming is controlled so that the voltage rise across the lamp which is encountered during dimming is never sufficiently great that the lamp will be extinguished.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
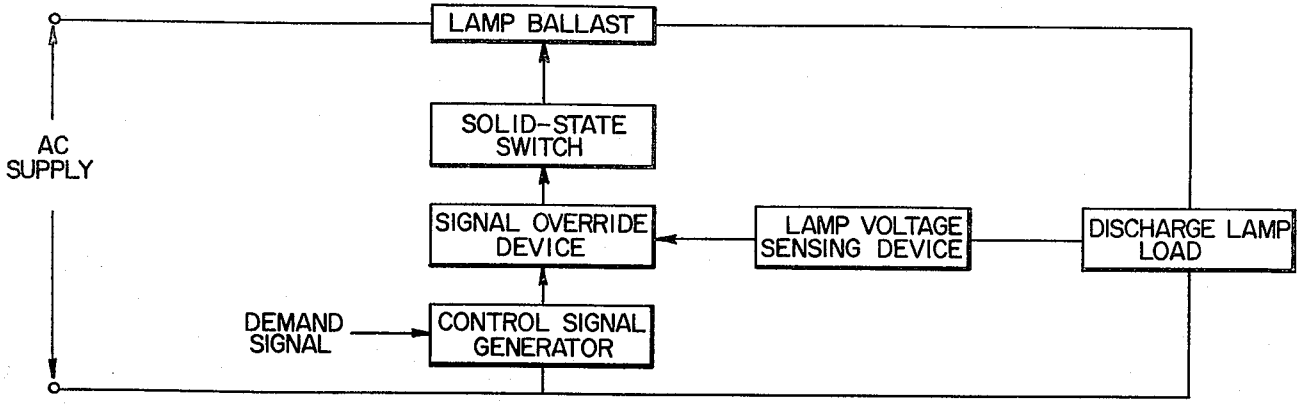
FIG. 1 is a block diagram illustrating the basic relationships of the circuit components, including the lamp voltage sensing device.

In FIG. 1 there is shown in block diagram the lighting control apparatus for providing a variable light intensity for HID lamps, such as high-pressure mercury-vapor lamps, while simultaneously preventing lamp drop out due to a rapid reduction of power to accomplish lamp dimming. The entire lighting control apparatus and the lamps being ballasted are all operated from a single AC supply which as an example can be 480 volts, 60 cycle. The initial control of lighting level is accomplished by a manually operated rheostat, for example, which operates with a control signal generator which produces a control signal timed to occur at a variable and controllable point in each half cycle of the AC power source. The control signal generator has its output fed into a signal override device and the output of a lamp voltage sensing device is also fed into the signal override device. As described hereinbefore, when a discharge lamp is dimmed, its voltage tends to rise and this rise in voltage is converted into a signal which will override the generated control signal if the lamp voltage appreciably exceeds its normal operating voltage. This in turn increases the power to the lamp which decreases the lamp voltage to prevent its extinguishing. The output of the signal override device controls the solid-state switch which in turn controls the variable reactance of the lamp ballast in order to control the power consumed by the discharge lamp load.

In the embodiment as shown in FIG. 1, the lamp ballast preferably comprises an inductive reactor of variable inductance. In its preferred form, the reactor comprises two portions which may be connected in parallel or in series and the individual reactor portions can be physically connected together or separated. If two reactor portions are provided, the ability to effectively remove one of the portions for a part of a half cycle provides a very efficient manner for controlling the power to the lamp.

If the two reactor portions are in parallel, a relatively low current from one of the reactor portions is supplied during the first portion of the half cycle with the solid-state switch acting to block the current through the other portion. For the remainder of the half cycle, a higher current is supplied through both reactor portions with the solid-state switch conducting.

If the reactor portions are placed in series, a low current which is limited by the sum of the inductances is supplied for the first portion of the half cycle and a higher current which is limited only by one inductance is supplied for the remainder of the half cycle when the solid-state switch conducts and bypasses the second reactor portion. Other arrangements which effectively change inductance from the high impedance to a low impedance for a portion of the half cycle can also be used.

Considering further the block diagram as shown in FIG. 1, the lamp voltage sensing device, which senses excessive voltage and increases the power to the lamp, is different from the normal feedback signal which normally is used to decrease the power to the load to offset a rise in voltage. In the case of HID lamps, however, by increasing the power to the lamp load, the voltage thereacross is decreased which in turn prevents lamp drop out due to a too-rapid reduction in power input to the load. The actual reduction in lamp load or in intensity of the lighting is quite slow and with such a slow reduction, a decrease in power of from 100% to about 5% is possible and this normally will require several minutes. It should be noted that it is generally impractical to manually reduce the power consumed by the lamp steadily over a period of several minutes and such a manual power reduction will normally result in lamp drop out at some point in the dimming operation.

Figure 2:
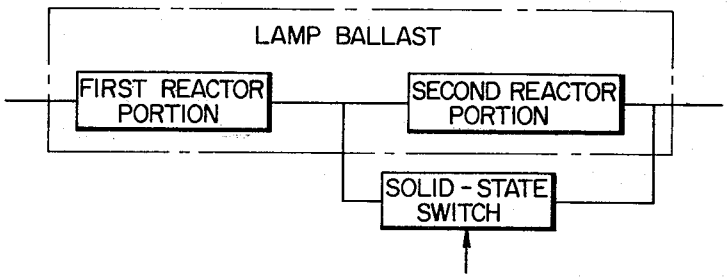
FIG. 2 is a block diagram of the preferred lamp ballast embodiment wherein the ballast reactor includes two portions, one of which is adapted to be bypassed by the actuated solid-state switch.

In FIG. 2 is illustrated the preferred ballasting arrangement, in block diagram, wherein two separate reactor portions are connected in series and the solid-state switch bypasses the second reactor portion when the switch is actuated. This arrangement is convenient in that a commercially available ballast can be used for both reactor portions. For a 400 watt mercury lamp, for example, a 100 watt lamp ballast can be used for the second reactor portion. When this second reactor portion is not shorted out by the solid-state switch, the current to the discharge lamp load is limited to a low level; for example, at steady state with both reactor portions in the circuit at all times, the discharge lamp is limited to about 5% of its maximum light output. A 400 watt lamp ballast is used with a 400 watt mercury lamp for the first reactor portion. When the solid-state switching device is conducting continuously, the second reactor portion is completely out of the circuit and the discharge lamps operate at full intensity. Thus by varying the portion of the half cycle for which the solid-state switch is conductive, lamp intensities of from 5% of maximum to 100% output can be provided.

Figure 3:
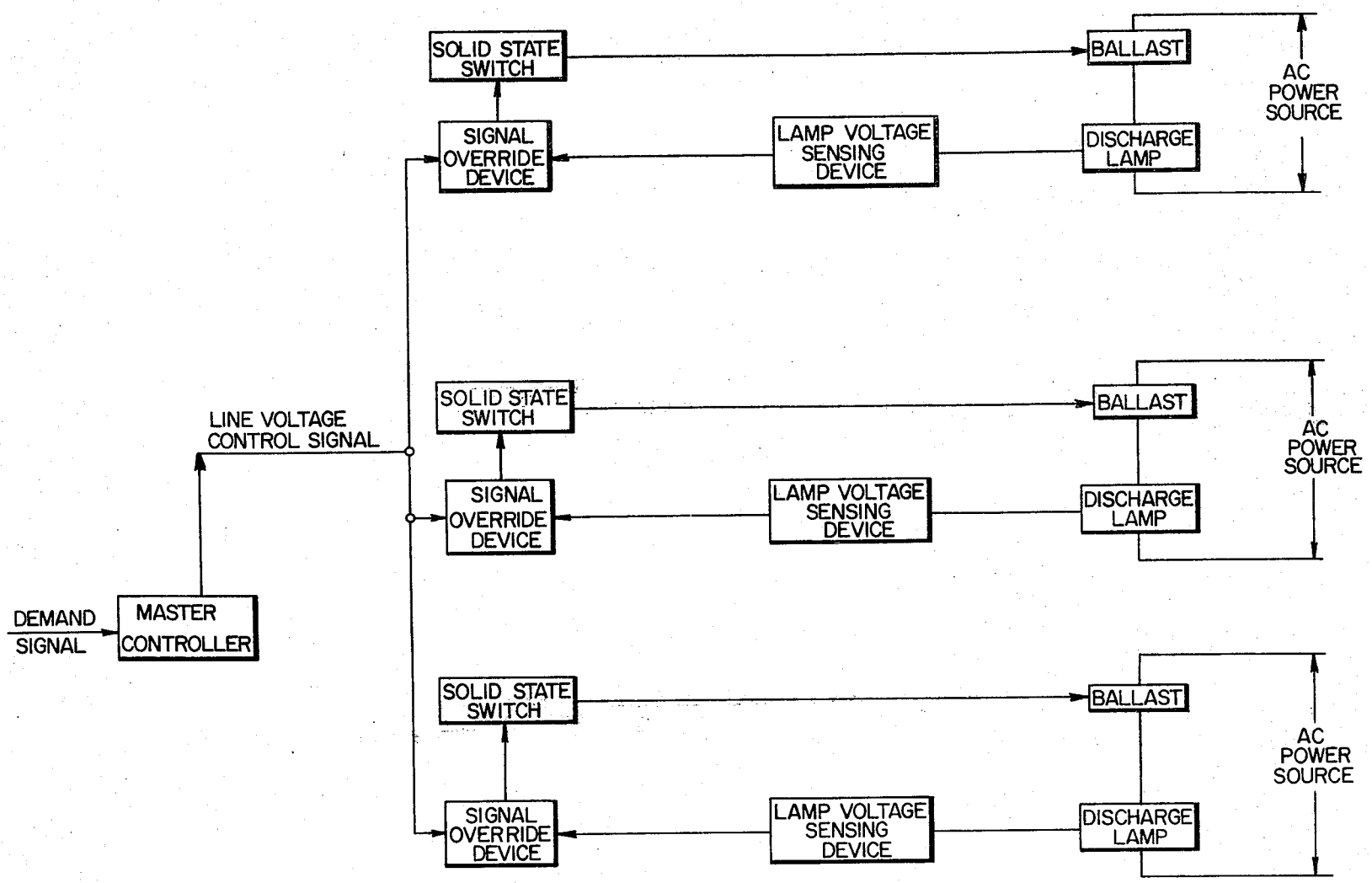
FIG. 3 is a block diagram of the preferred embodiment illustrating the use of a master-slave arrangement with a single line voltage control signal.

In FIG. 3 is shown a block diagram of a preferred embodiment illustrating the use of a master-slave arrangement wherein a single master device which generates a timed control signal can be used to actuate a plurality of slave arrangement. Each slave arrangement constitutes an individual lamp and its associated ballast, together with the individual signal override device and solid-state switch so that each lamp is carefully controlled on an individual basis. It is important that the master controller device and the slave systems all operate from the same AC power source since the phase must be maintained the same.

Figure 4:
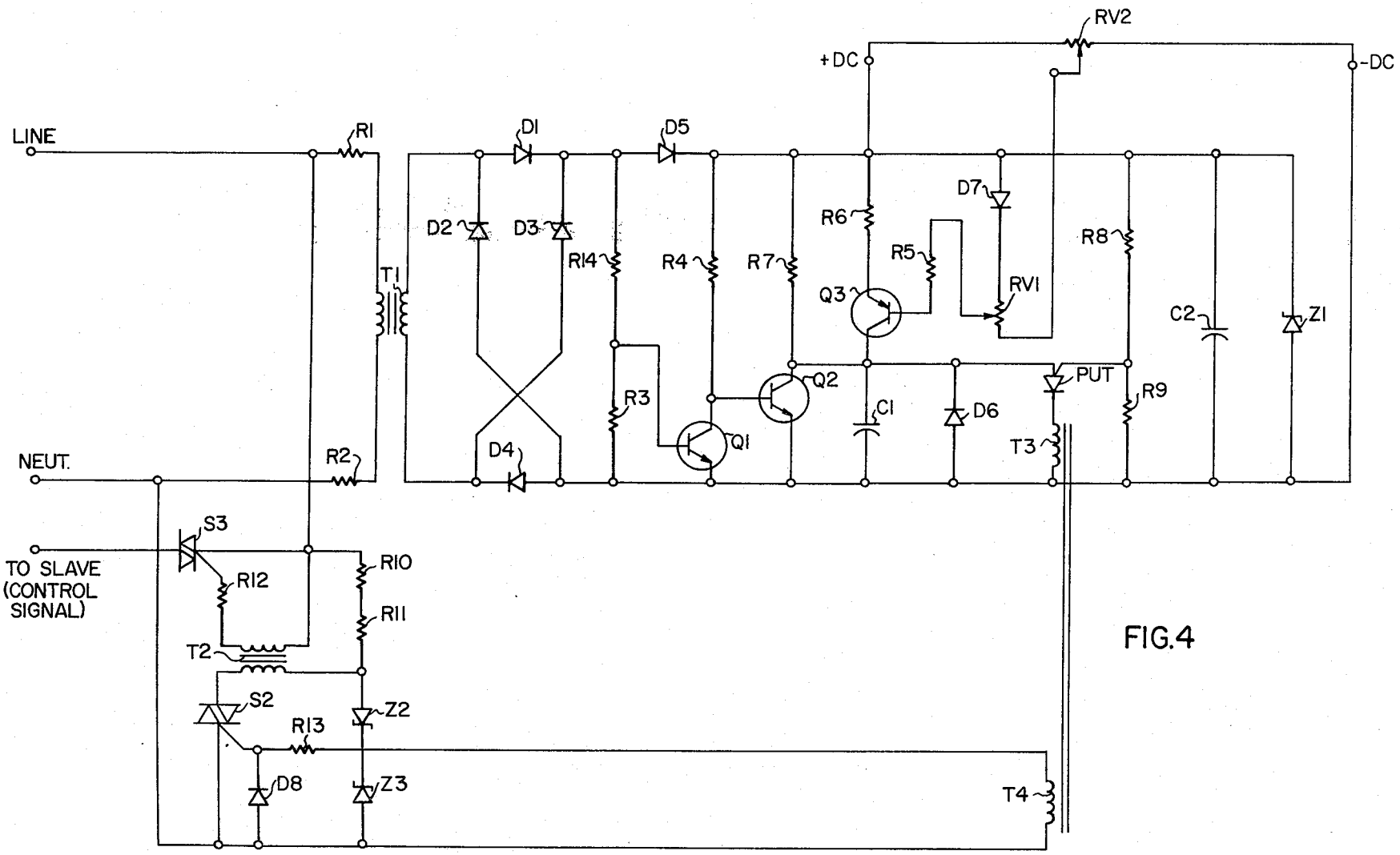
FIG. 4 is a schematic diagram showing a preferred embodiment of a master controller device for generating a master control signal.

In FIG. 4 there is shown the circuit diagram for the preferred embodiment of a master signal generator wherein the line voltage is supplied across transformer T1 with the output therefrom being rectified through the diode rectifier D1–D4. The resistors R3 and R14 function to sense the zero line voltage and the transistors Q1 and Q2 function as zero reset transistors, in order to reset each half cycle every time the line voltage passes through zero. The capacitor $C_1$ is charged to a variable ramp voltage depending upon the magnitude of the demand signal input and this causes the programmed unijunction transistor (PUT) to fire at varying times to generate a pulse in the pulse transformer T4. This in turn gates the triac S2 with the output thereof serving to gate the triac S3 to generate a line control signal voltage which energizes the slave units. A large number of different slave units, as many as several hundred if desired, can be operated from the single master control and once the triac S3 is triggered, there will be generated a continuous signal for the duration of the remainder of the half cycle.

The Zener diode Z1 regulates the voltage across C2 and the Zener diodes Z2 and Z3 minimize the voltage requirements for triac S2. By varying the potentiometer RV2, the magnitude of the demand signal is changed in order to vary the time during the half cycle in which the line voltage control signal is generated. The circuit of the master controller is quite similar to those which are conventionally used in conjunction with incandescent lamp dimmers.

The following Table I lists the master controller component values for a 480 volt installation.

TABLE I

| ITEM | DESCRIPTION |
|---|---|
| R1 | 75K, 2W, 5 % |
| R2 | 75K, 2W, 5 % |
| R3 | 33K, ½W, 5 % |
| R4 | 33K, ½W, 5 % |
| R5 | 33K, ½W, 5 % |
| R6 | 33K, ½W, 5 % |
| R7 | 33K, ½W, 5 % |
| R8 | 33K, ½W, 5 % |
| R9 | 33K, ½W, 5 % |
| R10 | 33K, 2W, 5 % |
| R11 | 33K, 2W, 5 % |
| R12 | 100r, ½W, 5 % |
| R13 | 270r, ½W, 5 % |
| R14 | 33K, ½W, 5 % |
| D1 | 1N645A |
| D2 | 1N645A |
| D3 | 1N645A |
| D4 | 1N645A |
| D5 | 1N645A |
| D6 | 1N645A |
| D7 | 1N645A |
| D8 | 1N645A |
| Q1 | 2N4123 |
| Q2 | 2N4123 |
| Q3 | 2N4126 |
| PUT | 2N6027 |
| C1 | .15/50V |
| C2 | 125MFD/50V |
| Z1 | 1N9708 |
| Z2 | 1N4756 |
| Z3 | 1N4756 |
| S2 | T2300A(40525) |
| S3 | T6410N(40926) |
| T1 | P8394 |
| T2 | P8394(117V/12(2)) |
| T3 | 11Z2000 |
| RV1 | 100K POT |
| | PCBO, 1001C93 |

Figure 5:
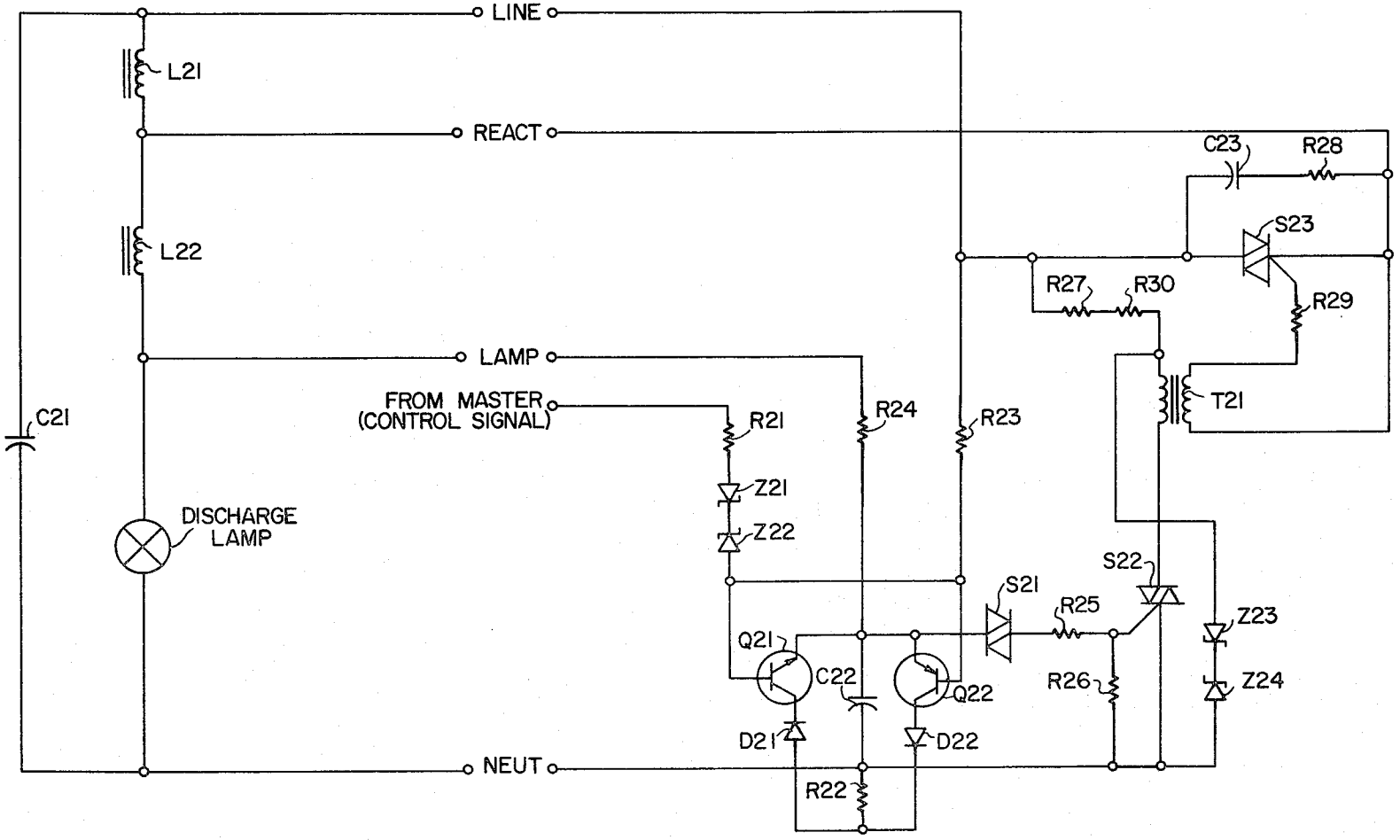
FIG. 5 is a schematic diagram of a preferred embodiment of a slave circuit, one or many of which can be used with the single master controller device as shown in FIG. 4.

In FIG. 5 is shown a schematic view of the slave portion of the circuitry along with the lamp load and associated series-connected inductances. The values of the ballast inductances L21, L22 and the power factor correction capacitor C21 are selected for the particular discharge lamp. As previously noted, with a 400 watt mercury lamp a standard 400 watt lamp ballast can be used as the first reactor portion L22 and a 100 watt lamp ballast can be used as the second reactor portion L21. The solid-state switch S23 is connected in parallel with the second reactor portion L21. The lamp voltage sensing device which develops a feedback signal comprises the elements R24 and C22. The initial control signal developed by the master unit is applied through R21, Z21 and Z22 and through Q21 or Q22 depending upon the phase, in order to charge the capacitor C22. In the actual operation, when the line is positive with respect to neutral, current flows through R23, the base of Q21, through C22 to neutral. R23 is chosen such that C22 will not charge to a voltage high enough to fire diac S21 and the purpose of R23 is to initialize the capacitor C22 voltage and to zero-reset C22 at each zero point of line voltage. As the control voltage input is increased, C22 charges and fires diac S21 which in turn gates triac S22. This in turn generates a pulse through the isolating transformer T21 and gates triac S23. Depending on when triac S23 is turned on, the inductor L21 is shunted for the remainder of the half cycle thereby increasing the current and power input to the discharge lamp load. When S23 is turned on the full period of each half cycle, the lamp is operating at full power and when S23 is completely off, the lamp current is limited by the series connected inductors L21 and L22 so that it operates at about 5% of its maximum rated power input in the embodiment as described. For lower wattage lamps, such as 100 watt high-pressure mercury-vapor lamps, R24 is preferably replaced by an RC combination such as a one megaohm resistor and a 0.0033 microfarad capacitor.

At maximum power input to the lamp load, a representative normal voltage drop thereacross is about 135 volts for a 400 watt lamp. At about 5% of the maximum power input, however, the normal voltage drop across the operating lamp load is only about 50 volts. When the power input to the lamp is rapidly lowered from maximum power, the voltage drop across the lamp will rapidly rise and if unchecked will rapidly achieve a value of about 170 to 180 volts, which will usually cause the lamp to extinguish. With the present apparatus, however, the voltage drop across the lamp will rapidly rise to a representative value of about 150 volts and this will cause the capacitor C22 to rapidly charge and override the control signal. As a result, the power input to the lamp will slowly decrease, as determined by the lamp cooling and the resultant decrease in voltage drop across the lamp. The signal developed by the voltage feedback charging of capacitor 22 will continue to control the lamp operation until the lamp cooling has decreased the voltage drop thereacross to the point where the control signal dominates the charging of C22, at which time the lamp will be operating at the brightness as determined by the demand signal.

By way of further explanation, lamp voltage feedback is fed to C22 by R24 and when the discharge lamp is operating at full power, and its arc current is then rapidly reduced, the arc voltage will normally rapidly increase until the arc extinguishes. To correct this too-rapid reduction in power and resultant excessive rise in lamp voltage, R24 feeds a current proportional to lamp voltage to the capacitor C22 which overrides the line control signal voltage applied to C22. This arrangement thus constitutes a signal sensing and signal overriding means for sensing the magnitude of the voltage feedback signal and causing this signal to override the lamp control signal during such time that the voltage drop across the operating lamp exceeds the normal operating voltage, thereby increasing the power input to the operating lamp until the voltage drop thereacross has decreased to the proper value. In this manner, the tendency for the lamp to extinguish during dimming thereof is compensated for. Ultimately the lamps will cool because of the reduced power input thereto and this will decrease the lamp voltage in a gradual fashion until it is operating in a stable fashion with the desired power input.

The foregoing master-slave arrangement of the preferred embodiment results in the solid-state switch S23 being triggered by a signal which continues for the remainder of the half cycle of the AC power source, rather than the short pulse which normally is used to trigger a triac. A premature pulse after the voltage has gone through zero, but before current reversal through the lamp because of the inductive load, is ineffective and no power would be supplied during that half cycle, with possible resultant blinking of the lamp or lamp drop out. This is corrected in the present circuit and is especially important when the lamp is operating with the very high power input, since the timing circuit in such case calls for very early activation of the triac S23.

In the following Table II are listed the slave circuitry component values for a 480 volt installation.

TABLE II

| ITEM | DESCRIPTION |
|---|---|
| R21 | 150K, 2W, 5 % |
| R22 | 47, ½W, 5 % |
| R23 | 2.7 MEG, ½W, 5 % |
| R24 | 1.0 MEG, ½W, 5 % |
| R25 | 270, ½W, 5 % |
| R26 | 10K, ½W, 5 % |
| R27 | 33K, 2W, 5 % |
| R28 | 1.5K, 1W, 5 % |
| R29 | 100, ½W, 5 % |
| R30 | 33K, 2W, 5 % |
| D21 | 1N645A |
| D22 | 1N645A |
| Z21 | 1N4756 |
| Z22 | 1N4756 |
| Z23 | 1N4756 |
| Z24 | 1N4756 |
| Q21 | 2N1711 |
| Q22 | 2N2905A |
| S21 | 1N5761A |
| S22 | T2300A |
| S23 | T6410N(40926) |
| C22 | .047/50V |
| C23 | .1/1000V |
| T21 | P8394 |
| | PC8D, 1001C92 |

I claim:

1. A lighting control apparatus which is responsive to a variable and controllable demand signal to control the power input to a high-pressure-discharge lamp means and thus vary the light output therefrom while preventing the lamp means from extinguishing because of a too-rapid reduction in power input thereto, said lamp means under normal full-power operating conditions displaying a predetermined voltage drop thereacross, said apparatus comprising:

a. ballasting means connectable in series with said lamp means and an AC power source, said ballasting means comprising a reactance means variable between a minimum value which causes said lamp means to operate at a maximum light output and a maximum value which causes said lamp means to operate at a minimum light output;

b. solid-state switching means connected to said ballasting means to controllably vary the reactance of said ballasting means in response to a timed control signal to vary in a controlled fashion the power input to said lamp means and thus vary the light output therefrom;

c. signal generating means responsive to said demand signal to generate a control signal timed to occur at a variable and controllable point in each half cycle of said AC power source, the output of said signal generating means connected to the input of said solid-state switching means, and said generated timed control signal rendering said solid-state switching means conductive for a variable and controllable portion of each half cycle of said AC power source;

d. lamp voltage sensing means for developing a feedback signal which varies in accordance with the voltage drop across said lamp means; and e. signal sensing and overriding means for sensing the magnitude of said feedback signal when said lamp means is operating with less than substantially maximum power input and with a voltage drop thereacross which is greater than the normal predetermined rated operating voltage therefor and for causing said sensed feedback signal to override said control signal and increase the power input to said operating lamp means and thus decrease the voltage drop thereacross, whereby the tendency for said lamp means to extinguish during dimming thereof is compensated for.

2. The lighting control apparatus as specified in claim 1, wherein said reactance means comprises a first reactance and a second reactance connected in series, and said solid-state switching means when in a conductive state provides an electrical by-passing of said second reactance.

3. The lighting control apparatus as specified in claim 1, wherein said high-pressure-discharge lamp means comprises two or more individual high-pressure-discharge lamps; each said lamp having an individual ballasting means, solid-state switching means, lamp voltage sensing means, and signal sensing and overriding means; and all of said individual lamps are controlled from a single master signal generating means.

4. The lighting control apparatus as specified in claim 1, wherein when said solid-state switching means is rendered conductive, it remains conductive for the remainder of the half cycle of said AC power source.

5. The lighting control apparatus as specified in claim 1, wherein said high-pressure-discharge lamp means comprises high-pressure mercury-vapor lamp means.

* * * * *